United States Patent [19]

Shimizu

[11] 4,307,757

[45] Dec. 29, 1981

[54] SIDE STAY OF HEDDLE FRAME

[75] Inventor: Yoichi Shimizu, Izumishi, Japan

[73] Assignee: Kabushiki Kaisha Maruyama Seisakusho, Sakaishi, Japan

[21] Appl. No.: 121,035

[22] Filed: Feb. 13, 1980

[30] Foreign Application Priority Data

Feb. 14, 1979 [JP] Japan ..... 54-6688[U]

[51] Int. Cl.[3] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 3,604,469 | 9/1971 | Schneiter et al. | 139/91 |
| 4,022,252 | 5/1977 | Ogura | 139/91 |
| 4,230,159 | 10/1980 | Shimizu | 139/91 |

FOREIGN PATENT DOCUMENTS

| | | | |
|---|---|---|---|
| 521448 | 7/1953 | Belgium | 139/92 |
| 2620778 | 4/1976 | Fed. Rep. of Germany | 139/92 |
| 365039 | 11/1962 | Switzerland | 139/92 |
| 288681 | 1/1971 | U.S.S.R. | 139/91 |

*Primary Examiner*—Henry Jaudon

*Attorney, Agent, or Firm*—Oblon, Fisher, Spivak, McClelland & Maier

[57] ABSTRACT

A side stay for a heddle frame is disclosed. The heddle frame has a hollow metal frame member which is filled with a plastic material and has an opening in one wall thereof. A supporting element extends from the plastic material through the opening in the metal frame and is insertable within a hollow side beam of the heddle frame, to which it may be fixed. The supporting element can be either unitary with the plastic material or connected to the frame via connecting elements.

3 Claims, 5 Drawing Figures

SIDE STAY OF HEDDLE FRAME

BACKGROUND OF THE INVENTION

1. Field of the Invention

This invention is concerned with improvements of side stays of heddle frames for looms.

2. Description of the Prior Art

The side stays of heddle frames are usually made of wood or metal such as aluminum, the former having the disadvantages of being mechanically weak and unable to endure a long period of service. And the latter has the disadvantages of requiring complicated joint structure of the side stay and side beam, resulting in difficult manufacturing of the side stay, is not adequate for mass production, and also has the disadvantage of heavy side stay weight which if being reduced by using, for example, aluminum base material, leads to higher material cost.

SUMMARY OF THE INVENTION

This invention is proposed in consideration of and to correct above conventional disadvantage for the purpose of offering a side stay of a heald frame which is adequate for mass production because it is easy to form and has high mechanical strength, sufficient to be applied to heavy duty high speed looms.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
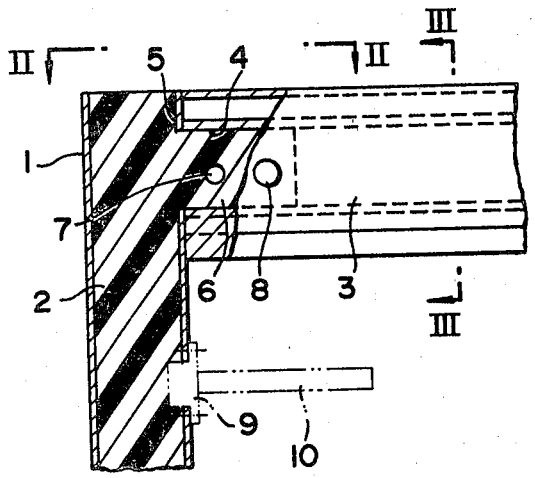
FIG. 1 is a partial sectional side view of a heddle frame assembled with a side stay of the present invention.
Figure 2:
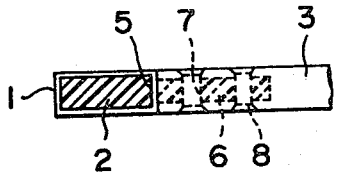
FIG. 2 is a plan view of FIG. 1 seen from the arrow direction at line II—II.
Figure 3:
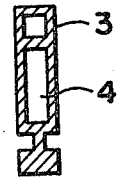
FIG. 3 is a sectional view taken on line III—III of FIG. 1 and seen in the arrow direction.

Referring now to FIG. 1 through FIG. 3, numeral 1 designates a hollow metal frame with a nearly square cross section, the interior of which is poured and filled with plastic material 2. Any rigid plastic, such as A.B.S., may be used.

Numeral 3 designates a side beam to which a square fitting-hole 4 is formed as shown in FIG. 3, and is usually made of aluminum material and formed by drawing in the shape shown in the figure.

Numeral 5 designates a hole cut in the side of the hollow metal frame 1, located in the position corresponding to the point of attachment with the side beam 3, and made similar in form and dimension with those of the fitting hole 4 of the side beam 3.

Numeral 6 designates a supporting element consisting of plastic material and supporting the side beam 3, the supporting element 6 being formed as one body with the plastic material 2 poured into the hollow metal frame 1, and protrudes from the hole 5 formed in the side of the hollow metal frame 1 by a predetermined length as shown in the drawing.

The supporting element 6 which protrudes from the hole 5 is inserted into the fitting-hole 4 at the end of the side beam 3. The inserted supporting element 6 and side beam 3 are connected and fixed by means of a rivet 8, through the hole 7 which is formed in the side face of the ends.

Numeral 9 designates a rod-bushing which is inserted into a hole formed on the side of the hollow metal frame 1 and fixed by a screw A rod 10 is fixed to the hole formed in the center of the rod-bushing, to fix the rod 10.

As will be obvious from the above description, the side stay of this invention is composed of the hollow metal frame 1, the plastic material 2 poured and filled in it and the supporting element 6.

Although in the above embodiment, the supporting element 6 is formed as one body with the plastic material 2, which is poured into the hollow metal frame 1, it may also be formed by locating a metal sheet in the middle of the supporting element 6, and enclosing the metal sheet with plastic material 2 as one body for the purpose of increasing the strength of the supporting element 6.

Figure 4:
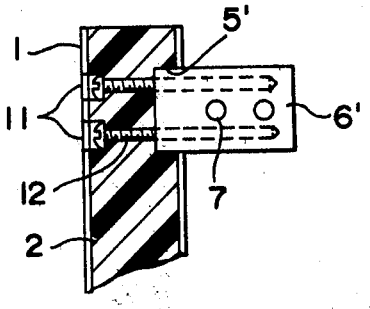
FIG. 4 and FIG. 5 are partial sectional views of the side stay of other example embodiments of the invention.
Figure 5:
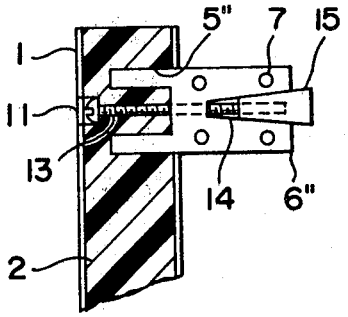

FIG. 4 and FIG. 5 are partial sectional views of the side stay in another embodiment of this invention in which the supporting element is composed of independent plastic pieces, and fixed to the side of the hollow metal frame poured and filled with plastic material.

In the embodiment shown in FIG. 4, a hole 5′ is cut in the side of the hollow metal frame 1 which is poured and filled with plastic material 2, and an end of the supporting element 6′, which is composed of separately manufactured plastic material, is fit into the hole 5′. Spot facings 11 are formed at two points of the opposite side of the hollow metal frame 1, from which tapping screws 12 are screwed so that their ends are buried deep in the supporting element 6′ and fix the supporting element 6′ strongly to the side of the hollow metal frame 1. In the drawing, numeral 7 designates a rivet-hole to connect and fix the side beam 3.

FIG. 5 is another embodiment of the invention in which a hole 5″ having two deep holes at the sides by the hollow metal frame 1 are poured and filled with plastic material 2 as shown in the figure. A separately manufactured plastic material supporting element 6″ having two legs is inserted by fitting the legs into the deep holes of the hole 5″; the face of the opposite side of the hollow metal frame 1 is spot faced, through which a bolt 13 is screwed to make the end protrude into the tapered groove 14 formed in the end center of the supporting element 6″ and screwed into the head of the cotter piece 15 which is fit into the tapered groove 14 so that the tightening of the bolt 13 makes the cotter piece 15 press in the tapered groove 14 to fix supporting element 6″ strongly, to form a side stay.

In the drawing, numeral 7 designates a rivet-hole to connect and fix the side beam 3. Although the supporting element 6′ or 6″ shown above in FIG. 4 and FIG. 5 are made separately with plastic material, another embodiment can also be used which makes supporting elements 6′ and 6″ as one body with the plastic material 2 poured and filled in the hollow metal frame 1 as shown in FIG. 1, and screws in tapping screw 12 or bolt 13 as shown in FIG. 4 and FIG. 5 for the purpose of reinforcing the supporting element.

Now, as shown in FIG. 5, by fitting cotter piece 15 into the tapered groove 14 formed in the end of the supporting element 6'', the opening of both sides of the tapered groove 14 will be slightly expanded by the elasticity of the plastics, causing the upper and lower sides of the end of the supporting element 6'' to be pressed towards the upper and lower inside faces of the fitting hole 4 of the side beam 3, resulting in the advantage of preventing loosening of the joining tightness between the supporting element 6'' and the side beam 3.

As explained above in detail, this invention, embodied in forming the side stay of the heddle frame by pouring and filling plastic material in the interior of a hollow metal frame having a nearly square cross section and formed at the side of the hollow metal frame at the position corresponding to the attaching portion of the side beam, a hole of almost the same form as the fitting hole of the end of the side beam, protruding a supporting element of plastic material fit into the fitting-hole of the side beam from the hole of the hollow metal frame, the supporting element being one body with the plastic material poured into the hollow metal frame, and with connecting means connect and fix the sides of the fitted support element and the end of the side beam with rivets, etc., and has many advantages as:

(1) Because of hollow metal frame is poured with plastic material, it is made quite light and suitable for heavy weight high speed looms, as well as allowing easy forming and low cost manufacture and is suitable for mass production.

(2) Because the plastic material is poured and filled in the hollow metallic frame, it does not deform by expansion because the frame has a larger section modulus and larger bending strength.

(3) Because the supporting element fit into the fitting-hole is made of plastic, bending stress or shock load arising in the side beam can effectively be absorbed, resulting in low noise.

The side stay of this invention is far more functional compared with a conventional one and can offer a quite practical and convenient side stay of the heddle frame.

What is claimed as new and desired to be secured by Letters Patent of the United States is:

1. A side stay for a heddle frame, comprising:

a substantially rectangular section hollow metal frame having an opening in one wall thereof;

a plastic material filling said hollow metal frame;

a supporting element extending through said opening from said plastic material and protruding from said frame;

a hollow side beam having an aperture at one end thereof, said supporting element being inserted into said aperture; and means for fixing said side beam to said supporting element, whereby said frame and side beam are rigidly secured to one another.

2. The side stay of claim 1 wherein said plastic material and supporting element are unitary.

3. The side stay of claim 1 wherein said supporting element is connected to said frame via connecting means.

* * * * *

UNITED STATES PATENT AND TRADEMARK OFFICE

CERTIFICATE OF CORRECTION

PATENT NO. : 4,307,757

DATED : Dec. 29, 1981

INVENTOR(S) : Yoichi Shimizu

It is certified that error appears in the above—identified patent and that said Letters Patent is hereby corrected as shown below:

Please correct the Priority Data to read as follows:

[30]---Foreign Application Priority Data

Feb. 14, 1979 [JP] Japan ..... 54-16688[U]

Please correct the Title to read as follows:

[54]---SIDE STAY OF HEALD FRAME---.

Signed and Sealed this

Sixth Day of April 1982

[SEAL]

Attest:

GERALD J. MOSSINGHOFF

Attesting Officer

Commissioner of Patents and Trademarks